United States Patent [19]

Honeycutt, III et al.

[11] Patent Number: 4,828,012

[45] Date of Patent: May 9, 1989

[54] APPARATUS FOR AND PROCESS OF DIRECT CASTING OF METAL STRIP

[75] Inventors: LeRoy Honeycutt, III; James C. Key, both of Salisbury, N.C.

[73] Assignee: National Aluminum Corporation, Pittsburgh, Pa.

[21] Appl. No.: 179,536

[22] Filed: Apr. 8, 1988

[51] Int. Cl.[4] ..... B22D 11/00; B22D 11/10; B22D 27/04

[52] U.S. Cl. ..... 164/479; 164/429; 164/338.1; 164/439; 266/236

[58] Field of Search ..... 164/437, 335, 429, 423, 164/463, 479, 338.1, 488, 489, 436; 266/236; 222/594

[56] References Cited

U.S. PATENT DOCUMENTS

| | | |
|---|---|---|
| 3,345,738 | 10/1967 | Nizikar et al. . |
| 3,431,971 | 3/1969 | Gyöngyös . |
| 4,250,950 | 2/1981 | Buxmann et al. . |
| 4,705,095 | 11/1987 | Gaspar . |
| 4,715,428 | 12/1987 | Johns et al. . |
| 4,749,024 | 6/1988 | Bartlett et al. . |
| 4,751,958 | 6/1988 | Flowers et al. . |

FOREIGN PATENT DOCUMENTS

| | | |
|---|---|---|
| 147912 | 10/1985 | European Pat. Off. . |
| 6035220 | 1/1982 | Japan . |
| 58-41656 | 3/1984 | Japan . |
| 622725 | 12/1978 | Switzerland . |

*Primary Examiner*—Kuang Y. Lin

*Attorney, Agent, or Firm*—O'Neil and Bean

[57] ABSTRACT

Disclosed are process and apparatus for use in the direct casting of metal strip from molten metal deposited on a moving chill surface from a tundish having a floor, opposed upwardly extending sidewalls, an end wall, an open outlet opposite the end wall with the open outlet extending substantially the full width of the tundish between the sidewalls, and an inlet for providing a flow of molten metal into the tundish from a source of molten metal. Flow diverters within the tundish divide the flow of molten metal into a plurality of separate streams and divert one of the streams in the direction of each sidewall and for recombining the diverted streams into a composite stream flowing toward the outlet. Flow diffusers diffuse the molten metal flowing through the tundish to provide molten metal of substantially uniform temperature across the width of the tundish at the outlet.

34 Claims, 3 Drawing Sheets

FIG. 1
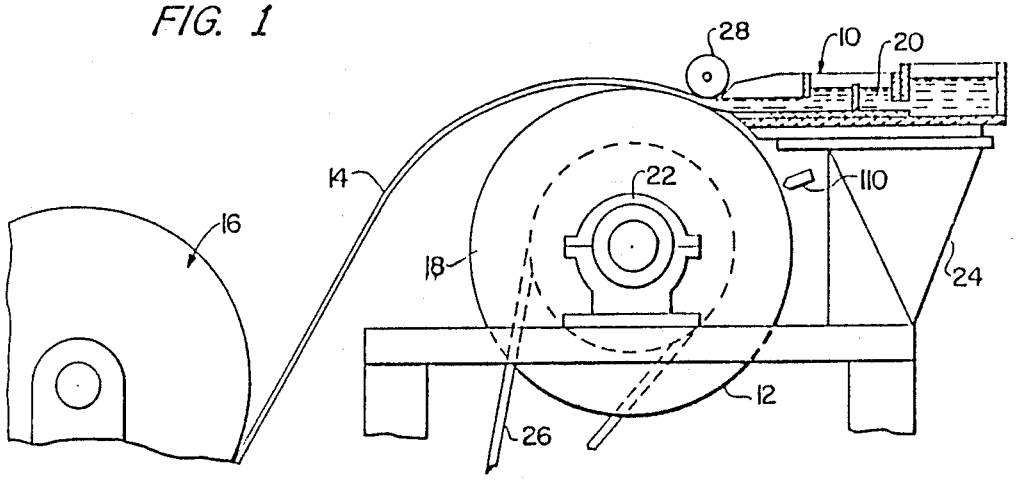
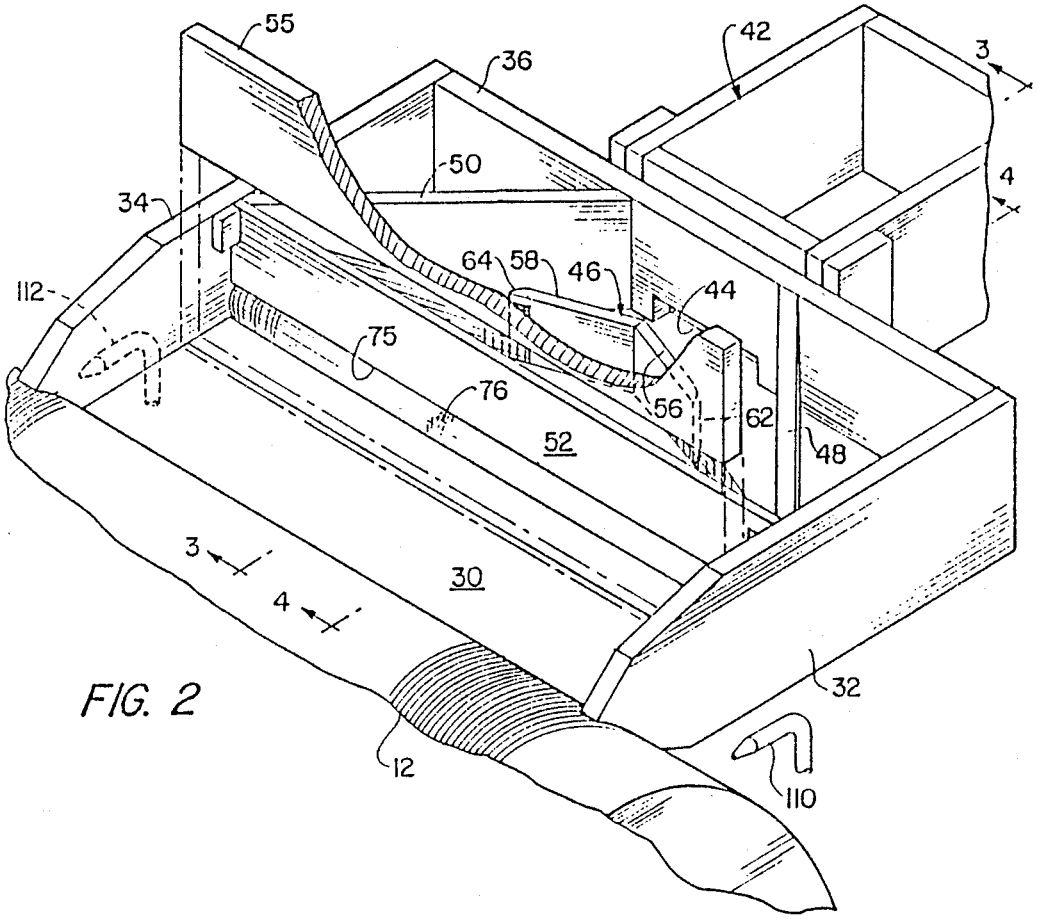
FIG. 2

APPARATUS FOR AND PROCESS OF DIRECT CASTING OF METAL STRIP

BACKGROUND OF THE INVENTION

1. Field of the Invention

This invention relates to process and apparatus for continuous direct casting of metal strip employing a moving chill surface upon which molten metal is flowed for solidification in combination with a tundish or other molten metal receiving vessel which delivers molten metal to the chill surface.

2. Prior Art

The advantages that may be achieved in direct casting of molten metal into thin strip or sheet (hereinafter "strip") on a continuous basis have long been recognized and numerous process and apparatus have been proposed for direct casting of metal strip. It is not believed, however, that any of the prior process or apparatus have been successfully used on a commercial basis, particularly for the production of a high quality, wide strip suitable for use in the as-cast condition for the production of commercial products, or for further processing as by rolling or shaping by other means.

In prior direct strip casting processes employing a continuously driven chill surface which contacts molten metal to be cast, the molten metal is solidified on the chill surface by extracting heat through the chill surface so that a thin skin of molten metal is solidified immediately upon contact with the chill surface. The thin skin increases in thickness as the chill surface moves progressively through or past the molten metal until the strip is completely formed. The thin skin initially formed is bonded or firmly adhered to the chill surface and the bonded contact results in a maximum heat transfer from the molten metal to the chill surface. As the solidifying skin progressively increases in thickness, the extraction of heat results in contraction of the solidifying strip at its bonded interface with the chill surface until the bond is broken, thereby resulting in a substantial reduction in the rate of heat extraction. The successful production of quality strip by the foregoing process depends to a large degree upon the extraction of heat at a uniform rate to obtain a uniform release of the cast strip from the chill surface. One process for obtaining the required uniform heat extraction through the chill surface is disclosed and claimed in copending U.S. patent application Ser. No. 155,710, assigned to the assignee of the present application, which involves establishing a natural oxide layer on the chill surface and maintaining the natural oxide interface in a smooth layer of substantially uniform thickness. The natural oxide layer is maintained in the required condition by engaging and polishing the natural oxide layer which is formed as a result of exposure of the chill surface to atmosphere. The polishing is effective only to remove the outermost particles of the oxide layer while leaving a packed layer of natural oxide firmly adhered to the chill surface.

Efforts to produce direct cast strip in commercially acceptable widths have revealed problems which are not encountered in the production of more narrow strips on laboratory or experimental apparatus. From a practical standpoint, a chill surface on which the strip is solidified must be substantially wider than the width of strip to be cast and in any commercial installation, the capital cost dictates that the casting wheel and other apparatus be capable of operation to produce strip of various widths. Cooling water circulating through a casting wheel will cool the portion of the chill surface adjacent each end of the casting wheel which does not contact the molten metal during operation which, in turn, will reduce the temperature of the chill surface in contact with the edge portions of the strip being cast. This results in more rapid cooling at the strip edges and can produce an increased thickness at the edges and a reduction of strip thickness near the edge. Such phenomena produces non-uniform strip cross section and relatively large edge thickness sometimes referred to as a "dog bone" shape.

Another problem encountered in producing acceptable strip of commercial widths results from the inherent tendency of molten metal to channel, or flow at non-uniform rates through the tundish or molten metal supply vessel (hereinafter, tundish) with the result that, in areas of most rapid flow, the temperature of the metal reaching the chill surface is higher than in the areas of slower flow. Temperature variations of the molten metal contacting the chill surface is manifested in strip thickness variations, and this problem tends to increase with increased strip width.

Numerous tundish designs are disclosed in the prior art but these known tundish designs, generally, do not recognize the problems in commercial operations and consequently do not suggest any solution to the problems. Typical prior art patents disclosing open tundish designs intended for use in the direct casting of metal strip on a moving chill surface include U.S. Pat. No. 4,715,428; European Patent Application No. 0147912; Swiss Patent No. 626,725; and Japanese Published Application No. 6,035,220. Also U.S. Pat. No. 3,431,971 discloses a tiltable open tundish for continuous casting of metal plate in a rotatable wheel type mold.

Of the above patents, U.S. Pat. No. 4,715,428 is specifically directed to tundish design, and the patent discloses a tundish having an open, generally U-shaped outlet. The tundish gradually decreases in depth and increases in width from its inlet to its outlet, and the patent suggests that plates 36, partially submerged in the molten metal, may be employed to facilitate development of uniform flow. These plates are used in baffling or dampening the flow to obtain uniformity of flow across the full tundish width and to restrain movements of surface oxides and slag. It is not suggested, however, that the plates 36 can reduce channeling or the effect of temperature at the tundish outlet.

It is accordingly, a primary object of the present invention to provide a novel tundish structure for use in the direct casting of thin metal strip.

Another object of the present invention is to provide a novel tundish structure for containing and supplying molten metal to a moving chill surface for producing a strip of commercially acceptable widths and of substantially uniform thickness throughout its width.

Another object of the invention is to provide a novel tundish structure for containing a supply of molten metal and for conducting the molten metal by gravity flow into contact with a moving chill surface in a manner to present molten metal to the chill surface at a substantially uniform temperature throughout substantially the full width of the strip being cast.

Another object is to provide a tundish which is economical to construct and maintain and which is reliable in operation and service.

SUMMARY OF THE INVENTION

The foregoing and other features and advantages of the present invention are obtained by a novel tundish structure and process in which the tundish is supported in a fixed position adjacent a rotating casting wheel for supplying molten metal to be cast on the moving chill surface. Molten metal is supplied from a supply chamber to the tundish through a submerged inlet. Flow dividers are provided for dividing the incoming stream of molten metal and diverting the divided streams in a direction toward the tundish sidewalls. Following diversion, the divided streams are mixed to provide a composite stream which is directed to the tundish outlet across its width.

Diffusion means are provided for diffusing the divided streams and the composite stream to eliminate channeling and to produce a substantially uniform flow rate through the tundish throughout its width as the metal approaches the chill surface. Obtaining uniform flow rate across the width of the tundish results in molten metal of a substantially uniform temperature being presented to the chill surface for the production of a more uniform commercially acceptable strip.

Means are also provided for compensating for the tendency of the chill surface to extract heat at a greater rate adjacent the edges of the strip. This may be accomplished by reducing slightly the depth of metal presented at the edges of the tundish lip by increasing slightly the thickness of the lip adjacent the edges of the strip. Alternatively, means may be provided for heating the chill surface in areas adjacent the edges of the strip prior to contact of the chill surface with the molten metal.

BRIEF DESCRIPTION OF THE DRAWINGS

The foregoing and other features and advantages of the present invention will be apparent from the following detailed description taken in conjunction with the accompanying drawings, in which:

FIG. 1 is a schematic view in elevation and partly in section of a direct casting apparatus embodying the principles of the present invention;

FIG. 2 is a three-dimensional view of apparatus shown in FIG. 1;

DESCRIPTION OF THE PREFERRED EMBODIMENT

Figure 3:
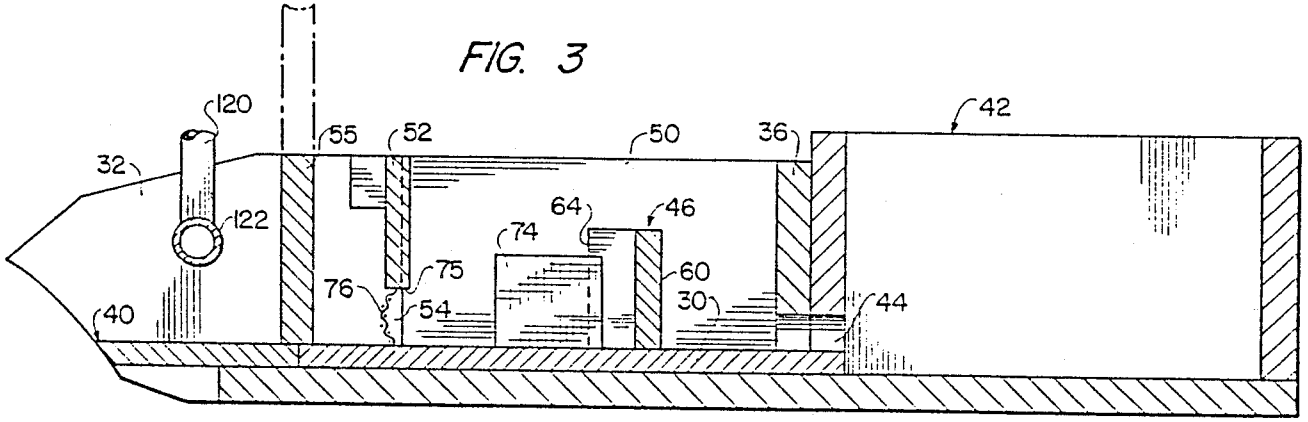
FIG. 3 is a view in section taken along the line 3—3 of FIG. 2.

A direct casting apparatus suitable for use in practicing the present invention is schematically shown in FIG. 1 of the drawings. As shown, a tundish 10 is located in close proximity to a chill surface 12 of a casting wheel upon which molten metal is solidified as strip 14 which is withdrawn from the casting apparatus and coiled in a conventional manner on coiler 16.

The chill surface 12 comprises the external cylindrical surface of a casting wheel 18. The casting wheel 18 is internally cooled with circulating water or other cooling liquid to rapidly extract heat through the chill surface 12 to quench and solidify molten metal 20 provided by the tundish which contacts the chill surface 12 as the casting wheel rotates upwardly through the molten metal. The chill surface 12 is preferably roughened or grooved as shown in U.S. Pat. Nos. 3,345,738 and 4,250,950. Suitable means such as journal bearings 22 support the casting wheel for rotation about a fixed horizontal axis on a rigid supporting frame 24. Suitable drive means such as a variable speed motor and reduction gear mechanism, not shown, and a drive chain or belt 26 are provided to rotate the casting wheel about its fixed horizontal axis. The exit end of the tundish is located in close proximity to the chill surface 12 and molten metal from the tundish is flowed along a transverse lip into contact with the moving chill surface. The apparatus also includes a top roll 28 which is uncooled or heated and mounted for rotation in contact with molten metal prior to complete solidification of the strip. Details of the top roll process and apparatus are disclosed and claimed in copending U.S. patent application Ser. No. 152,486, filed Feb. 5, 1988 for APPARATUS FOR AND PROCESS OF DIRECT CASTING OF METAL STRIP, assigned to the assignee of the present application.

As shown in FIGS. 2, 3, 4 and 5, the tundish 10 provided by the present invention includes a floor 30, laterally spaced upwardly extending opposed parallel sidewalls 32 and 34, a rear end wall 36 and an open end which is effectively closed by the chill surface 12. The floor 30 terminates at the open end of the tundish in a transversely extending contoured lip 40. Molten metal is flowed to the tundish 10 from a supply or surge chamber 42 through a submerged inlet port 44 formed in a wall of the supply chamber 42 and in the end wall 36, molten metal being supplied to the chamber 42 by any suitable means such as a ladle or hot metal transfer system from a melting furnace. A first upwardly extending wall 48 extends from sidewall 32 to the end wall 36 and is connected thereto at a point adjacent the lateral edge of inlet port 44, and a second wall 50 extends from sidewall 34 to end wall 36 and is joined thereto adjacent the other lateral edge of the inlet port. Walls 48, 50 thus extend in diverging relation from the inlet port 44 to the parallel sidewalls 32 and 34 and cooperate therewith to define the metal containing chamber of the tundish, with the diverging walls 48 and 50 being disposed to eliminate or minimize any areas of stagnant liquid metal during operation.

The tundish 10 includes a novel combination of means for dividing, diverting and diffusing molten metal in the tundish to obtain the objects of the present invention, including control of the rate of flow of the molten metal onto the chill surface across the transverse width of the tundish lip, control of the temperature of the molten metal transversely of the tundish lip, and providing controlled minimized turbulence of the molten metal discharged from the tundish. This facilitates control of the strip gauge and transverse shape by enabling a more uniform heat transfer through the chill and thereby reduce longitudinal cracks in the cast strip and improve the gauge, shape and quality of the cast strip. The molten metal dividing and diverting means of the combination includes a central baffle 46, the diverging walls 48 and 50, and a flow restricting wall or dam 52 presenting a submerged opening 54 adjacent the tundish floor extending across the full transverse width of the tundish between the sidewalls 32 and 34.

The central baffle 46 includes a pair of planar plates 56 and 58 having one edge joined together along a common line 60 and extending in angular relationship to form a chevron or V-shaped structure terminating in free edges, or ends, 62 and 64. The central baffle is disposed in the tundish with its apex located on the longitudinal vertical centerplane of the tundish and facing the flow of molten metal into the tundish through the opening 44. The free edges 62, 64 of the central baffle are spaced inwardly from the diverging wall 48, 50, respectively, to provide a pair of laterally spaced flow passages around the central baffle. A pair of flow diffusers 72, 74 extend one between the free edge 62 of the central baffle and the wall 48 and a second between the free edge 64 and the wall 50. Flow diffusers 72, 74 are preferably formed of a refractory or other suitable material capable of withstanding the temperature of the molten metal to be cast and are provided with a uniform pattern of small openings to divide and diffuse the flow of metal passing through the space between these central baffles and the opposed, diverging walls of the tundish. For the casting of aluminum strip, a woven screen formed from a fiberglass material has been found to provide the desired diffusion and to withstand the temperature and fluid pressure, and to resist erosion so that it provides a very satisfactory diffusion material. Further, screen means having ⅛ inch mesh, for example, provides the additional function of retarding the flow of oxides or slag on the surface of the metal.

The flow control wall 52 is positioned downstream of the diverging walls 48, 50 and the central baffle 46 and extends across the full transverse width of the tundish with its bottom edge 75 extending in vertically spaced relation to the top surface of the floor 30. The opening 54 between the bottom edge 75 and floor 30 is preferably slightly less than the maximum depth of liquid metal downstream of the wall 52 during a casting operation. A third flow diffuser means 76, again preferably in the form of a screen, extends over and completely covers the open space between the top surface of floor 30 and the bottom edge 75 of transverse wall 52 to provide uniform flow diffusion across the transverse width of the tundish during operation. At the same time, the screen 76 acts as a flow restrictor which, in combination with the positioning of the wall 52, results in the level of the metal upstream of the wall being above the bottom edge 75 so that the wall acts as a skimmer, holding back any oxides floating on the surface of the molten metal and producing a head differential across the screen to provide a uniform, diffused flow of metal from beneath the layer of oxide. The diffusion effect of the screen, as well as of screens 72 and 74, produce light turbulence in the stream in the form of small eddies which prevent the channeling of metal and provide a more uniform flow and consequently minimizes temperature differential across the width of the tundish at the contoured lip 40. Turbulence produced by the diffusers, however, is not great enough to cause mixing of floating oxides, slag or other impurities with the liquid metal flowing through the tundish.

A flow control gate 55 is mounted for vertical sliding movement between the sidewalls 32, 34 downstream of the wall 52. Gate 55 is adapted to be moved from a lowered position in which its bottom edge engages the top surface of floor 30, completely preventing the flow of metal to the contoured lip 40, and a raised position out of contact with the molten metal to permit free flow, by gravity, downstream of the wall 52.

Figure 6:
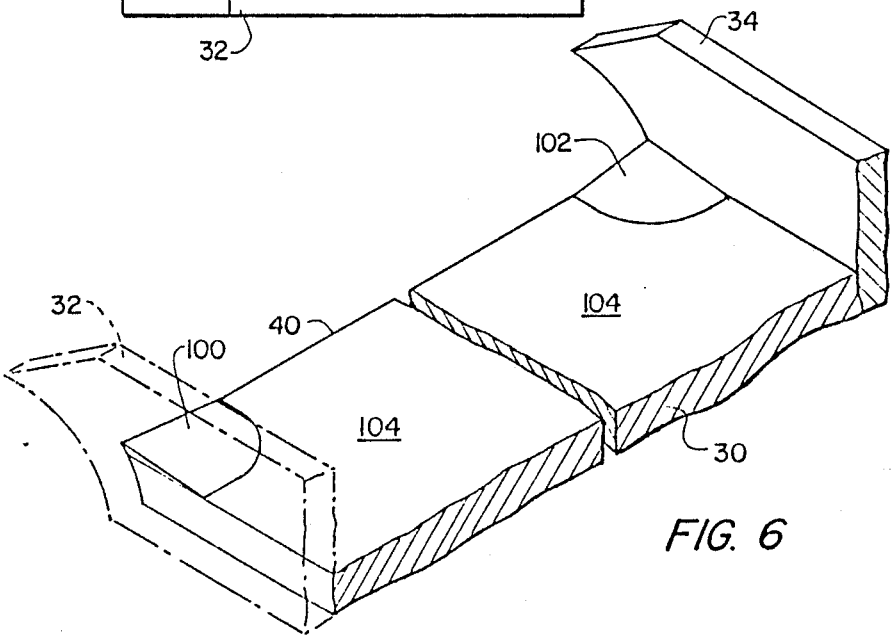
FIG. 6 is a three-dimensional view of a detail of the apparatus of FIG. 2.

As discussed above, in operation of a typical direct casting system employing a casting wheel presenting a chill surface, the circulating coolant through casting wheel 18 cools a portion of the chill surface 12 adjacent each end of the casting wheel which does not contact the molten metal during casting. This condition will tend to reduce the temperature of the adjacent portion of the chill surface which contacts the marginal edges of the strip and produce a more rapid cooling of the strip edges. This can result in an increased thickness of the marginal edges of the strip which can cause problems in coiling the strip and may require the excessive edge trimming and a consequent production loss. It has been found that this problem may be overcome or substantially avoided without excessive loss of product and without adversely affecting the quality of the cast strip. This is accomplished by increasing the thickness of the transverse lip 40 of the tundish adjacent to the sidewalls 32, 34 to thereby reduce the contact time between the molten metal and the chill surface adjacent the marginal edges of the strip. As shown in FIG. 6, this may be accomplished by providing a pair of thin inserts or risers 100, 102 located on and bonded to the top surface 104 of the floor 30, one adjacent each sidewall 32, 34 at the lip 40, that is, at the corners defined by the sidewalls and the lip.

Risers 100 and 102 preferably are of generally rectangular configuration in both longitudinal and transverse cross section to provide maximum-thickness at the point of intersection of the front lip and tapering both longitudinally and transversely from this point of maximum thickness to smoothly blend into the top surface 104 of the floor. The thickness as well as the longitudinal and transverse dimensions of risers 100 and 102 will be determined by various factors including the rate of casting, the depth of metal in the tundish and the temperature of the molten metal which flows over the top surface of the lip.

The present invention also contemplates overcoming the "dog bone" effect without sacrificing product by the application of heat to an area of the chill surface to but outboard of the marginal edges of the chill surface which contacts the molten metal. Such application of heat reduces or eliminates the more rapid cooling along the marginal edge portion of the strip with the advantages outlined above. The heating may be accomplished by providing a pair of gas burners 110 and 112 in position to direct a flame or a jet of hot gas onto the chill surface at a location outboard of and adjacent to the portion which contacts the molten metal forming the edges of the strip. The heat is preferably applied to the chill surface of the casting wheel at a location beneath the tundish and just prior to contact with the molten metal, and sufficient heat is applied to compensate for or overcome the chilling effect on the strip normally produced by the cold marginal edges of the chill surface. The area to which the heat is applied and the intensity and quality of heat used will, of course, be determined by various factors including the casting rate, strip thickness and the temperature of the molten metal. The edge thickness can thus be easily controlled during operation by varying the heat applied to the chill surface through adjustment of the intensity and position of the heat applied by the burner.

It should be understood, of course, that chill surface heating and tundish risers may be employed independently of one another or in combination, as required, to overcome the "dog bone" effect and produce strip of the desired commercial quality with minimum waste from edge trimming. The use of the two systems together provides a convenient and economical means for accurately controlling the "dog bone" effect.

Figure 4:
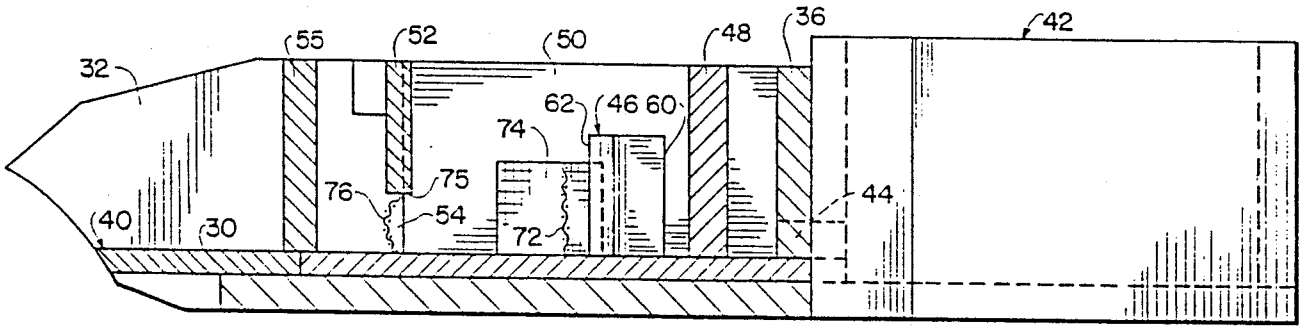
FIG. 4 is a view in section taken along the line 4—4 of FIG. 2.
Figure 5:
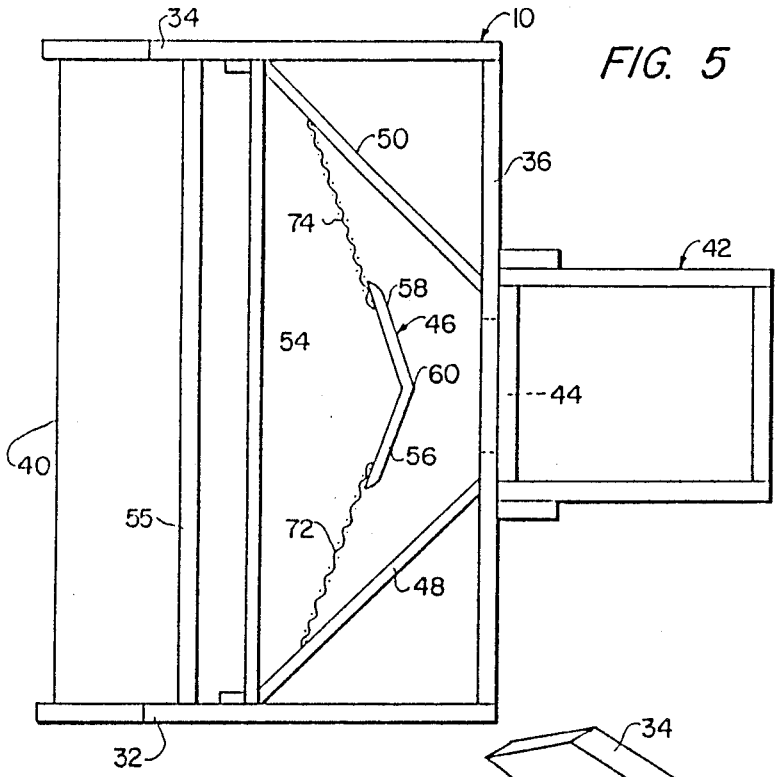
FIG. 5 is a plan view of the apparatus shown in FIG. 2.

A tundish described above and shown in FIGS. 2, 3, 4, 5 and 6 has been constructed and operates with a rotatable, cooled wheel for the production of 30 inch wide commercial quality aluminum strip. The casting wheel presented a chill surface provided with generally circumferential grooves 79, and a top roll 28 driven by the casting wheel in the manner described in copending application Ser. No. 152,486 was employed. The casting wheel was made of steel having a diameter of 27.635 inches and a chill surface width of 42 inches. The free ends of the opposed sidewalls 32 and 34 were contoured to be compatible with the external surface of the casting wheel and the transverse dimension between the sidewalls 32 and 34 was 30 inches, the width of the strip to be cast. The tundish floor and walls were constructed utilized Pyrotek and ceramic boards for thermal insulation, and were reinforced with structural members for stability and structural integrity. The tundish included a horizontal floor 30 having a length of 23 inches between end wall 36 and lip 40, and the sidewalls were 7 inches high. A supply chamber 42 was provided adjacent end wall 36, and the inlet port 44 between the supply chamber and the tundish was 5½ inches long, had a vertical dimension of 1 inch and was disposed symmetrically about the longitudinal vertical centerplane of the tundish with its bottom edge in the plane of the floor 30. The center baffle 46 was positioned symmetrically with respect to the central vertical plane of the tundish with the plates 56 and 58 each disposed at an angle of 15 degrees from the end wall 36 to form a V-shaped structure having its apex facing the flow of molten metal through the inlet, with the plates defining an included angle of 150 degrees. The walls 48 and 50 were extended from a point adjacent each end of the inlet 44 to the sidewalls 32, 34, respectively, and were oriented at an angle of 45 degrees from the wall 36. Diverting and diffusing screens 72, 74 were located in the space between the central baffle 46 and the walls 48, 50, respectively. The screens 72 and 74 extended in substantially coplanar relationship with the plates 56 and 58, respectively, and each comprised a fiberglass mesh screen of number 35 weave and ⅛ inch mesh. A similar diffusion screen extended over and covered the submerged transverse opening 54 and was bowed forwardly as shown in FIGS. 3 and 4.

The inserts or risers 100,102 located in the corners of the sidewalls and the lip, had a maximum vertical thickness of ¼ inch and were tapered to feather into the surface 104 of the tundish at the lip 2 inches from the sidewalls.

In operation of the tundish constructed in the manner described above, the gate 55 is moved to the closed position and molten metal is supplied to chamber 42 and permitted to flow through opening 44 into the tundish until the metal in the tundish reaches a level above the top of screen 76. The gate 55 is then moved to the open position out of contact with the molten metal, and molten metal flows through the tundish onto contact with the chill surface 12 of the casting rotating wheel 18. When equilibrium conditions are established, molten metal from the supply chamber 42 flows through the entry port 44 to impinge upon the plates 56 and 58 of the center baffle 46 and is divided into two separate streams, one flowing through the diffusion screen 72 and the other through screen 74. The low velocity stream of molten metal are uniformly diffused by the screens and converge downstream of the central baffle as a single, composite stream reaching the wall 52. The screens 72 and 74 also act as skimmers, holding back oxides and impurities floating on top of the molten metal, thereby producing an "underflow" resulting in a more uniform velocity of the streams throughout the depth of the streams.

The composite stream then flows through the screen 76 in the submerged opening 54 to further uniformly diffuse the molten metal and provide slight but substantially uniform turbulence which acts to diffuse the stream across its full width. This results in a more uniform flow and temperature throughout the transverse width of the tundish between the sidewalls 32 and 34 at the lip 40. The effect of slight, unavoidable flow differential produced by friction with the sidewalls 32 and 34, and any slight temperature variation resulting therefrom are compensated for by use of the risers 100 and 102 which substantially eliminate the "dog bone" effect.

Flow restrictions provided by the diffusers 72 and 74 and by the wall 52 and its associated diffuser screen 76 produce head variations between the surge chamber 42, the portion of the tundish upstream of wall 52 and the portion downstream of wall 52. The flow diffusers help compensate for minor head level fluctuations and produce a more uniform molten metal level at the tundish lip 40.

A cover (not shown) for the top of the tundish is preferably employed to provide an enclosure for receiving and containing an inert atmosphere. An inert gas from a source. (not shown) may be fed by conduit 120 to an internal manifold 122 for discharging inert gas into the enclosure.

The apparatus just described has been employed to produce commercial quality aluminum strip. In one such run, 5000 pounds of 30 inch strip was produced during a period of 18.5 minutes. The strip had a substantially uniform thickness of 0.045 inches, and the transverse profile was substantially uniform and free of the "dog bone" effect. The top surface of the strip was substantially free from cracks and other defects which can be produced by non-uniform heat transfer through the chill surface resulting from metal temperature and strip thickness variations.

It is believed apparent that numerous factors will influence the design and construction of the tundish according to the present invention. These factors may include the type of metal, or alloy, being cast, the width and thickness of the strip to be cast, and the casting speed. Thus, for casting 30 inch aluminum strip having a thickness of up to about 0.045 inches, the configuration described has been found satisfactory; however, for casting wider strip, it may be desirable to provide additional baffles to further divide or divert the submerged inlet stream to provide an even flow distribution across the width of the tundish, or it may be necessary or desirable to provide a plurality of submerged inlets, with each being divided into two or more substreams for subsequent combination into a single composite, diffused stream reaching the tundish lip.

It is also contemplated that diffusion means, such as screens, providing different flow restrictions across the width of the tundish may be employed, particularly in the casting of wider strips. Also, the shape and configuration of the central baffle described herein may vary depending upon the flow characteristics and patterns desired in the tundish.

While a preferred embodiment of the invention has been disclosed and described, it should be understood that the invention is not so limited but rather that it is intended to include all embodiments which would be apparent to one skilled in the art and which come within the spirit and scope of the invention.

What is claimed is:

1. Process for direct casting of molten metal to form strip by solidification of molten metal on a moving chill surface using a vessel having a floor, spaced sidewalls, an inlet and an outlet extending between the sidewalls, comprising:

positioning the vessel with the outlet adjacent the chill surface;

providing a source of molten metal to be cast;

withdrawing an inlet stream of molten metal from the source and flowing the inlet stream into the vessel through the inlet;

dividing the inlet stream into a first stream and a second stream;

diverting the first stream in a direction toward one sidewall of the vessel;

diverting the second stream in a direction toward the other sidewall of the vessel;

diffusing the first stream and the second stream;

intermixing the diffused streams to form a composite stream extending throughout the width of the outlet;

and flowing the composite stream in a direction toward the outlet.

2. Process for direct casting of molten metal to form strip as defined in claim 1 in which the inlet stream is divided and diverted by flowing the inlet stream to impinge on angularly disposed baffle means.

3. Process for direct casting of molten metal to form strip as defined in claim 2 in which the vessel includes diffusion means disposed in the path of said first and said second stream, and in which said first and said second streams are diffused by flowing the steams through the diffusion means.

4. Process for direct casting of molten metal to form strip as defined in claim 3 in which the divided and diverted streams are diffused by flowing the stream

5. Process for direct casting of molten metal as defined in claim 1, in which risers are provided on the floor surfaces adjacent each sidewall at the transverse edge to reduce the depth of molten metal in the areas of the risers.

6. Process for direct casting of molten metal to form strip by solidification of molten metal on a moving chill surface using a vessel having a floor, spaced sidewalls, an inlet, and an outlet extending between the sidewalls, comprising:

positioning the vessel with the outlet adjacent the chill surface;

providing a source of molten metal to be cast;

withdrawing an inlet stream of molten metal from the source and flowing the inlet stream into the vessel through the inlet;

dividing the inlet stream into a first stream and a second stream;

diverting the first stream in a direction toward one sidewall of the vessel;

diverting the second stream in a direction toward the other sidewall of the vessel;

diffusing the first stream and the second stream;

intermixing the diffused streams to form a composite stream; and diffusing the composite stream to provide an outlet stream of substantially uniform thickness extending throughout the width of the outlet.

7. Process for direct casting of molten metal to form strip as defined in claim 6 in which the vessel includes angularly disposed baffle surfaces and in which the inlet stream is divided and diverted by flowing the inlet stream to impinge on the baffle surfaces.

8. Process for direct casting of molten metal to form strip as defined in claim 7 in which the vessel includes diffusion means, and in which the first and second divided and diverted streams and the composite stream are diffused by flowing the streams through the diffusion means.

9. Process for direct casting of molten metal to form strip as defined in claim 8 in which the divided and diverted streams and the composite stream are diffused by flowing the streams through screens.

10. Process for direct casting of molten metal to form strip as defined in claim 9 in which the composite stream is caused to flow through a submerged opening extending between the sidewalls of the vessel defined by a flow restricting wall member having its bottom edge spaced above the floor and below the surface of said composite stream, and in which the composite stream is diffused by flowing through a screen extending between said floor and said flow restricting wall.

11. A tundish for use in direct casting of molten metal on a chill surface of predetermined width comprising:

means for providing a source of molten metal;

means for withdrawing an inlet stream of molten metal from the source and for dividing the inlet stream into a first divided stream and a second divided stream;

means for oppositely diverging the first divided stream and the second divided stream;

means for diffusing the first divided stream and the second divided stream;

means for combining the diffused streams to form a composite stream; and means for flowing the composite stream in a direction toward the chill surface.

12. A tundish as defined in claim 11 including means for diffusing the composite stream.

13. A tundish as defined in claim 11 in which the means for diffusing the first divided stream and the second divided stream includes means for flowing the divided streams through-screen means.

14. A tundish as defined in claim 13 in which the means for diffusing the composite stream includes means for flowing the composite stream through screen means.

15. A tundish for use in direct casting of molten metal to form strip by solidification of molten metal on a moving chill surface, comprising:

a vessel including a floor, first and second opposed sidewalls, and an outlet having a transverse discharge surface for flowing a stream of molten metal onto the moving chill surface;

means providing a source of molten metal to be cast;

central baffle means, inlet means for directing a flow of molten metal from the source into the vessel in a direction to impinge on said central baffle means to be divided into a first stream and a second stream;

first diverting wall means positioned in the path of flow of the first stream to divert the first stream in the direction of said outlet;

second diverting wall means positioned in the path of flow of the second stream to divert the second stream in the direction of said outlet;

means for diffusing and combining the first and the second diverted streams to form a composite, diffused stream flowing toward said outlet; and means for diffusing the composite stream to form an outlet stream of substantially uniform depth and velocity throughout its width.

16. A tundish as defined in claim 15 in which the central baffle means includes a first end in spaced relation with the first diverting wall means and a second end in spaced relation with the second diverting wall means;

first diffusion means in the space between the first end of the central baffle and the first diverting wall means; and second diffusion means in the space between the second end and the second diverting wall means.

17. A tundish as defined in claim 16 in which the first and second diffusion means comprises screen means extending from the vessel floor to a position above said first and second divided streams.

18. A tundish as defined in claim 17 in which the central baffle includes angularly disposed baffle surfaces joined together at an apex and presenting free edges; said central baffle being positioned in said vessel with said apex in the path of the flow from the inlet, said screen means being joined one to each free edge of said central baffle and extending to said diverting walls.

19. Apparatus for use in direct casting of metal strip from molten metal deposited on a moving chill surface comprising:

a tundish having a floor and an open top, opposed upwardly extending sidewalls, an end wall, and an open outlet opposite said end wall, said open outlet extending substantially the full width of the tundish between said sidewalls;

an inlet for providing a flow of molten metal into the tundish from a source of molten metal;

divider means within the tundish for dividing the flow of molten metal into a plurality of separate streams and for diverting one of said separate streams in a direction toward each sidewall and for recombining the divided streams into a composite stream flowing toward said outlet, and first diffuser means for diffusing the composite stream at a point between said dividing means and said outlet to provide molten metal of substantially uniform temperature across the width of the tundish at the outlet.

20. The apparatus defined in claim 19 further comprising second diffuser means for diffusing said plurality of separate streams prior to the separate streams being recombined to form the composite stream.

21. The apparatus defined in claim 20 wherein said floor has a substantially horizontal planar surface adjacent said outlet, said floor further comprising means at said outlet adjacent each said sidewall for raising the elevation of said floor surface to thereby reduce the depth of molten metal flowing from said outlet in the area adjacent each said sidewall.

22. The apparatus defined in claim 20 wherein said moving chill surface has a width transversely of said tundish which is greater than the transverse width of said outlet, said chill surface being positioned relative to said tundish outlet to project laterally outward from said outlet at each side of the tundish, said apparatus further comprising heater means for applying heat to said chill surface in the area outboard of said outlet at each side of said tundish.

23. The apparatus defined in claim 22 wherein said floor has a substantially horizontal planar surface adjacent said outlet, said floor further comprising means at said outlet adjacent each said sidewall for raising the elevation of said floor surface to thereby reduce the depth of molten metal flowing from said outlet in the area adjacent each said sidewall.

24. A process for direct casting of molten metal to form strip by solidification of molten metal on a moving chill surface using a vessel having a floor, spaced sidewalls, an inlet, and an outlet extending between the sidewalls, the process comprising the steps of:

positioning the vessel with the outlet adjacent the chill surface;

providing a source of molten metal to be cast;

flowing molten metal from the source into the vessel through the inlet;

dividing the flow of molten metal entering the vessel into a plurality of streams;

diverting one of said plurality of streams in a direction toward each sidewall of the vessel;

diffusing said plurality of streams and recombining the diffused streams to form a composite stream of substantially uniform depth extending throughout the width of the vessel; and flowing the recombined composite stream to the outlet to contact the chill surface.

25. The process defined in claim 24 in which the step of dividing the flow of molten metal entering the vessel comprises providing baffle means in the vessel and causing the molten metal to impinge on the baffle means to be divided and diverted thereby.

26. The process defined in claim 24 in which the step of diffusing the plurality of streams of molten metal comprises flowing each of said plurality of streams through a stationary flow diffuser extending across its path.

27. The process defined in claim 26 wherein said stationary flow diffuser is in the form of a screen, and in which the screen and the baffle means project upwardly above the surface of the molten metal, and employing the screens and baffle means as a skimmer to inhibit the flow of oxides and other impurities floating on the surface of molten metal in the tundish.

28. The process defined in claim 24 wherein the inlet is a submerged inlet, and wherein the baffle is an upwardly extending baffle disposed in the vessel in position for the molten metal to impinge upon and be divided by the baffle into two substantially equal streams, and wherein the step of diffusing the two streams comprises flowing the streams through a flow diffuser extending between the baffle and each sidewall of the vessel.

29. The process defined in claim 24 further comprising the step of diffusing the composite stream to provide an outlet stream of substantially uniform thickness and velocity extending substantially across the full width of the vessel at the outlet.

30. The process defined in claim 29 wherein said floor has a substantially horizontal surface adjacent said outlet, and further comprising the step of providing a reduced depth of metal flowing from said outlet adjacent each sidewall portion only of the vessel.

31. The process defined in claim 29 wherein the chill surface is in the form of a cooled cylindrical wheel surface rotated adjacent said outlet, said chill surface extending outwardly from said sidewalls on each side of the vessel, the process further comprising the step of applying heat to the chill surface in the area of the vessel sidewalls and outboard of the outlet.

32. The process defined in claim 31 wherein said floor has a substantially horizontal surface adjacent said outlet, and further comprising the step of providing a reduced depth of metal flowing from said outlet adjacent each sidewall portion only of the vessel.

33. A process for direct casting of metal strip from molten metal by solidifying molten metal on a moving chill surface using vessel having a floor, spaced sidewalls, an inlet, and an outlet extending between the sidewalls and positioned adjacent the moving chill surface, the chill surface having a transverse dimension greater than that of the vessel and extending outwardly from the outlet on each side of the vessel, the process comprising the steps of providing a source of molten metal to be cast, flowing molten metal from the source into the vessel through the inlet, flowing the molten metal through the vessel to the outlet in a stream of substantially uniform depth at the outlet and, applying heat to the chill surface in the area outboard of the outlet at each side of the vessel to thereby prevent excessive cooling of the molten metal adjacent the side edges of the strip being formed whereby a strip of more uniform thickness is produced.

34. In an apparatus for direct casting of metal strip from molten metal by solidifying molten metal on a moving chill surface, including a vessel having a floor, spaced sidewalls, and an outlet extending between the sidewalls and positioned adjacent the moving chill surface, the chill surface having a transverse dimension greater than that of the vessel and extending outwardly from the outlet on each side of the vessel, the improvement comprising:

a source of molten metal to be cast;

inlet means providing a flow of molten metal from the source into the vessel;

means for flowing the molten metal through the vessel to the outlet in a stream of substantially uniform depth at the outlet; and heating means operable to apply heat to the chill surface in the area outboard of the outlet at each side of the vessel to thereby prevent excessive cooling of the molten metal adjacent the side edges of the strip being formed whereby a strip of more uniform thickness is produced.

* * * * *

UNITED STATES PATENT AND TRADEMARK OFFICE

CERTIFICATE OF CORRECTION

PATENT NO. : 4,828,012

DATED : May 9, 1989

INVENTOR(S) : Honeycutt et al

It is certified that error appears in the above-identified patent and that said Letters Patent is hereby corrected as shown below:

Front page, Box [75], after"Key,", insert --Herbert Moody III, all"

second line, delete "both".

Column 6, line 39, after "surface", insert --adjacent--.

Column 9, line 43, after "stream", insert --through a screen.--

Column 13, line 13, after "using", insert --a--.

Signed and Sealed this

Twenty-third Day of January, 1990

*Attest:*

JEFFREY M. SAMUELS

*Attesting Officer*

*Acting Commissioner of Patents and Trademarks*